US007102482B2

(12) United States Patent
Andre

(10) Patent No.: US 7,102,482 B2
(45) Date of Patent: Sep. 5, 2006

(54) RELAY AND CROSS-CONNECT

(75) Inventor: Tore Andre, Alvsjo (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 10/509,842

(22) PCT Filed: Apr. 2, 2002

(86) PCT No.: PCT/SE02/00656

§ 371 (c)(1),
(2), (4) Date: Oct. 1, 2004

(87) PCT Pub. No.: WO03/083888

PCT Pub. Date: Oct. 9, 2003

(65) Prior Publication Data

US 2005/0195057 A1 Sep. 8, 2005

(51) Int. Cl.
*H01H 37/74* (2006.01)

(52) U.S. Cl. ..... 337/389; 257/259

(58) Field of Classification Search ..... 337/389; 257/529

See application file for complete search history.

(56) References Cited

U.S. PATENT DOCUMENTS 2,844,778 A * 7/1958 Seely et al. ..... 361/32
4,124,835 A 11/1978 Cahill, Jr.
5,084,691 A 1/1992 Lester et al.
5,537,108 A * 7/1996 Nathan et al. ..... 257/529
5,612,662 A * 3/1997 Drekmeier et al. ..... 337/389

FOREIGN PATENT DOCUMENTS

JP 61 053862 7/1986
JP 03 214534 9/1991
JP 03263729 11/1991

OTHER PUBLICATIONS

Patent Abstracts of Japan, vol. 015, No. 490 (E-1133), Dec. 11, 1991.
Patent Abstracts of Japan, vol. 016, No. 073 (E-1169), Feb. 21, 1992.
Pataent Abstracts of Japan, vol. 010, No. 271 (E-423), Jul. 29, 1986.
Swedish Pataent Office, International Search Report for PCT/SE02/00656, dated Oct. 28, 2002.

* cited by examiner

*Primary Examiner*—Lincoln Donovan
(74) *Attorney, Agent, or Firm*—Roger S. Burleigh

(57) ABSTRACT

The present invention relates to a fuse-relay including a first pole (1, 11, 21, 31, 81) and a second pole (2, 12, 22, 32, 82). According to the invention the fuse-relay includes a resilient device (5, 18, 27, 37, 87) that is held in an elastically deformed position by a fuse (6, 16, 26, 36, 86) when the fuse (6, 16, 26, 36, 86) is whole; and in that the resilient device (5, 18, 27, 37, 87) is arranged to make or break a connection between the first pole (1, 11, 21, 31, 81) and the second pole (2, 12, 22, 32, 82) when the fuse (6, 16, 26, 36, 86) is blown. The invention also relates to a cross-connect with such fuse-relays, to a telecommunication system with such cross-connects and to a connection method.

3 Claims, 18 Drawing Sheets

RELAY AND CROSS-CONNECT

TECHNICAL FIELD

The present invention relates to a relay, to a cross-connect and to a method for connecting xDSL modems and similar.

BACKGROUND OF THE INVENTION

Digital Subscriber Line (DSL) is a technology that dramatically increases the digital capacity of ordinary telephone lines into a home or office. The different versions of DSL include for example ADSL (Asymmetrical DSL), HDSL (High bit rate DSL) and VDSL (Very high bit rate DSL), which are commonly denoted as xDSL.

Now, not all subscribers may want to have xDSL, therefore in some subscriber line equipment, the total number of subscriber lines are higher than the number of xDSL modems. When a new subscriber order a xDSL subscription, then a manual installation procedure is required, wherein an unused xDSL modem is connected to the subscriber's line. This is a costly operation.

A way of reducing the manual intervention is to use a cross-connect in the form of a switch-matrix or similar. This is done in e.g. U.S. Pat. No. 5,905,781 wherein mechanical or electrical relays are used, WO 01/45431 wherein mechanical or solid-state relays are used, and U.S. Pat. No. 6,262,991 wherein switches are mentioned. The switches/relays are then digitally controlled to enable a subscriber to be connected to one of the xDSL modems.

SUMMARY OF THE INVENTION

The problem with existing solutions of cross-connects is that the total number of relays will be quite high and relays are expensive, quite large and often consume a lot of power.

The purpose of the present invention is to solve this problem by using a new type of relay. An intelligent part of the invention is to realise that in most cases it is only necessary to connect a subscriber's terminal to a modem, but seldom to disconnect. Thus, a simple type of relay can be used, which is described in claim 1.

The advantages are that such a relay is simple, small and cheap, which also makes the cross-connect cheap and connections may be made remotely in a simple way. Further advantages will follow from the different embodiments.

The invention will now be described in closer detail with the aid of preferred embodiments and with reference to enclosed drawings.

PREFERRED EMBODIMENTS

Figure 1:
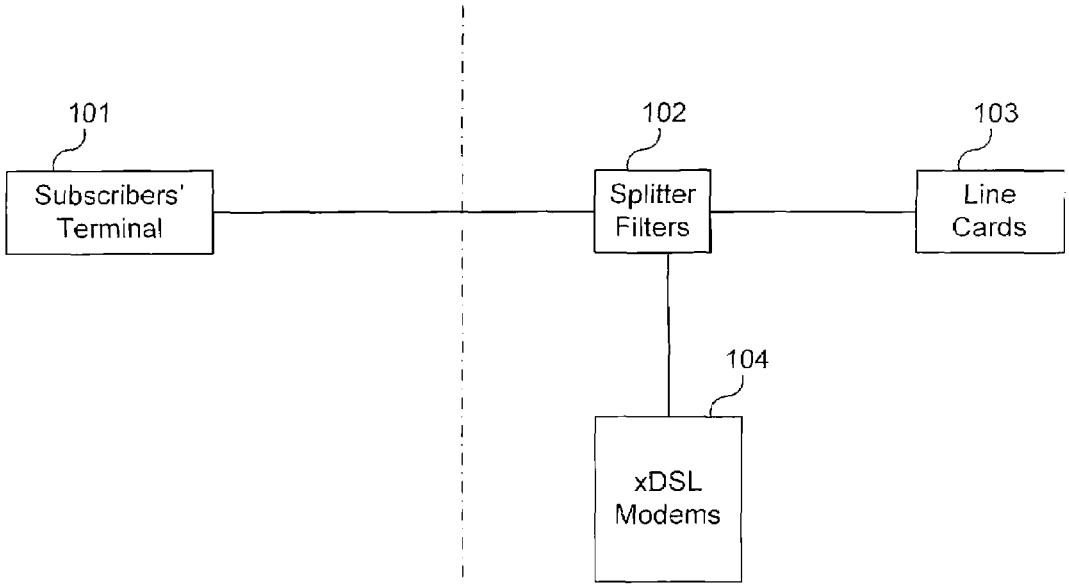
FIG. 1 shows a communication system with xDSL modems

FIG. 1 shows a simplified view of a telecommunication system. Subscribers' terminals 101 are connected to splitter filters 102. The low pass sides of the splitter filters 102 are connected to line cards 103, providing PSTN services, and the high pass sides of the splitter filters are connected to xDSL modems 104, providing xDSL services.

Figure 2:
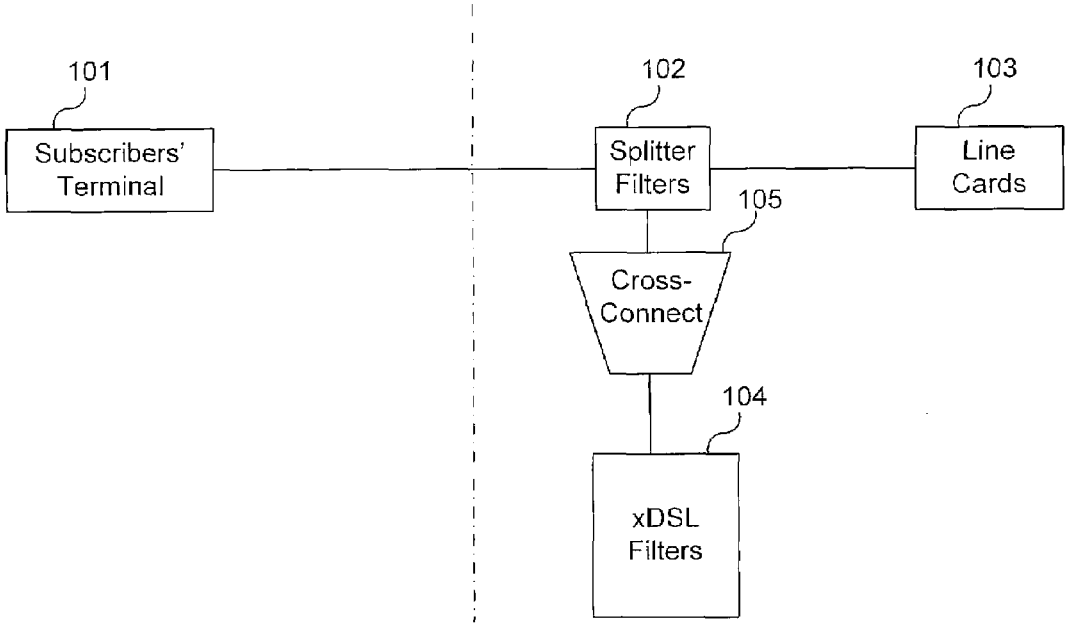
FIG. 2 shows an embodiment of a communication system according to the invention with xDSL modems and a cross-connect according to the invention

Since not all subscribers want xDSL services it would be a waste to install one modem per subscriber. In FIG. 2 is shown according to the invention a way to have a few xDSL filters 104 that easily can be connected to the subscribers' terminals 101. A cross-connect 105 is placed between the splitter filter 102 and the xDSL modems and has the ability to connect any of subscriber's user terminals 101 with any of the xDSL modems 104. The cross-connect 105 will be described in more detail below.

Figure 3:
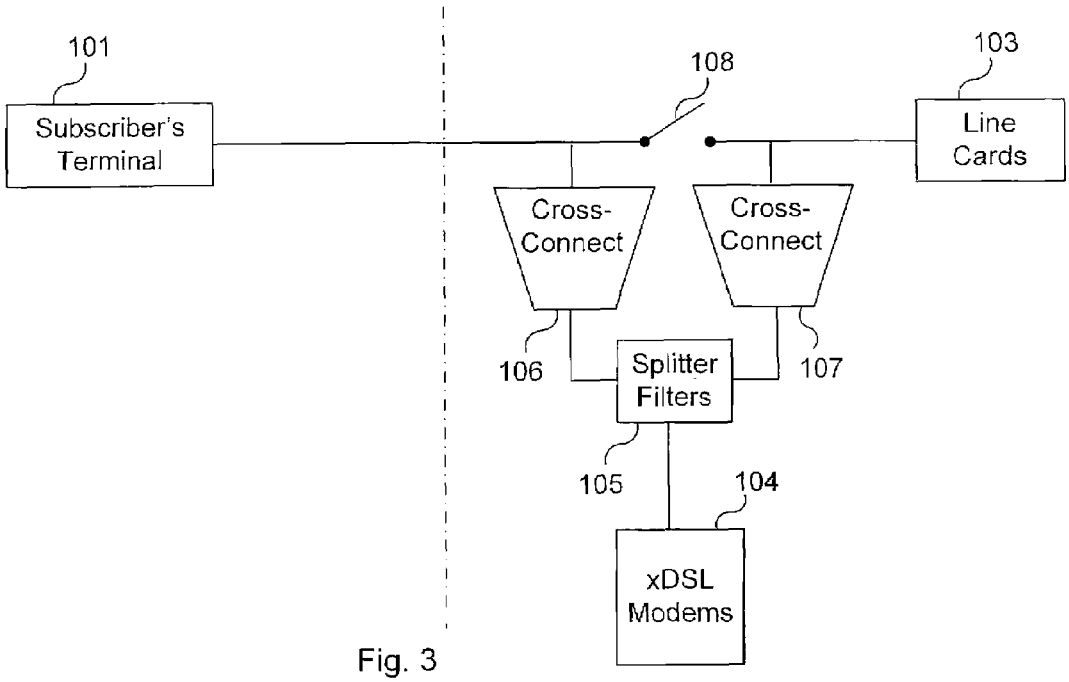
FIG. 3 shows an embodiment of a communication system according to the invention with xDSL modems and two cross-connects according to the invention

An alternative solution is shown in FIG. 3. If there is a wish to spare also splitter filters then two cross-connects, 106, 107, one on each side of the splitter filters 105 can be used. Further, separate relays 108 are provided. In the basic case for a subscriber, the relay 108 is closed and thus provides connection between the subscriber's terminal 101 and his line card 103. If the subscriber wants to have xDSL, then the relay 108 is opened, while other relays within the cross-connects 106, 107 are closed. In this way a connection is provided from the subscriber's terminal 101 to the line card over the splitter filter 105 and thus access to the xDSL modem 104 will also be obtained.

Figure 4:
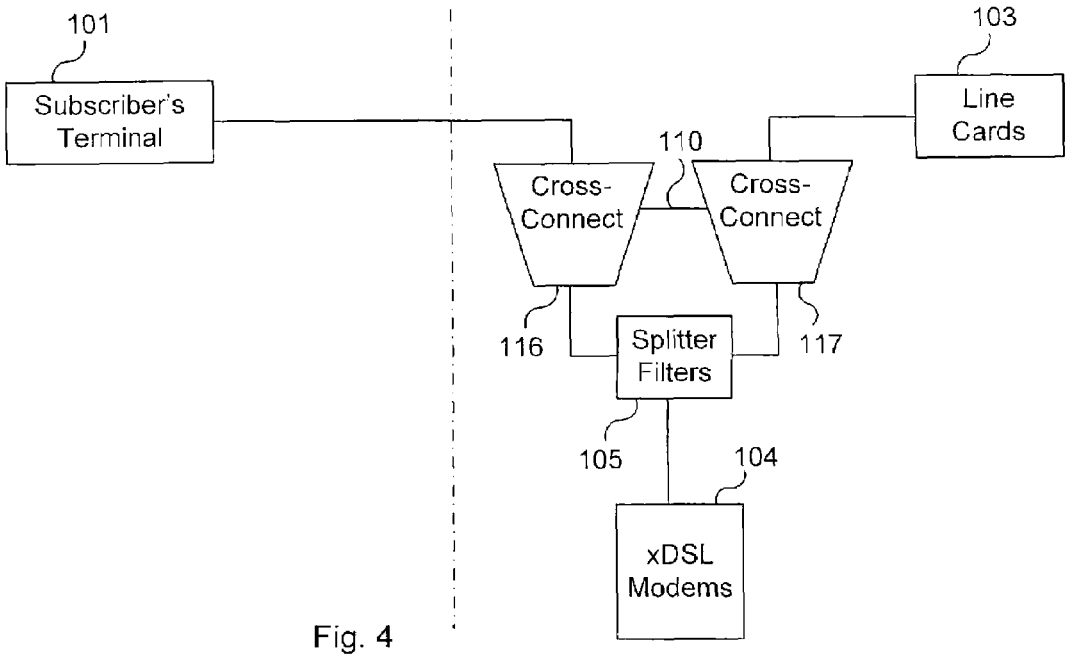
FIG. 4 shows an embodiment of a communication system according to the invention with xDSL modems and two cross-connects according to the invention FIGS. 5*a* and *b* shows a first embodiment of a fuse-relay of a make contact type according to the invention FIGS. 6*a* and *b* shows a second embodiment of a fuse-relay of a make contact type according to the invention FIGS. 7*a* and *b* shows a third embodiment of a fuse-relay of a make contact type according to the invention FIGS. 8*a* and *b* shows a fourth embodiment of a fuse-relay of a make contact type according to the invention FIGS. 9*a* and *b* shows a fifth embodiment of a fuse-relay of a make contact type according to the invention FIGS. 10*a* and *b* shows a first embodiment of a fuse-relay of a break contact type according to the invention FIGS. 11*a* and *b* shows a second embodiment of a fuse-relay of a break contact type according to the invention FIGS. 12*a* and *b* shows a third embodiment of a fuse-relay of a break contact type according to the invention FIGS. 13*a* and *b* shows a fourth embodiment of a fuse-relay of a break contact type according to the invention FIGS. 14*a* and *b* shows a first embodiment of a fuse-relay of a change-over type according to the invention FIGS. 15*a* and *b* shows a second embodiment of a fuse-relay of a change-over type according to the invention FIGS. 16*a* and *b* shows a third embodiment of a fuse-relay of a change-over type according to the invention FIGS. 17*a* and *b* shows a fourth embodiment of a fuse-relay of a change-over type according to the invention FIGS. 18*a, b* and *c* shows an embodiment of a fuse-relay with indicator and test button FIGS. 19*a* and *b* shows a first embodiment of a cross-connect according to the invention

A further alternative is shown in FIG. 4. It is like FIG. 3, but no separate relay is needed because two cross-connects 116, 117 are provided which include change-over relays. The changeover relays are arranged so that in the basic case they provide connection between the subscriber's terminal 101 and his line card 103 directly over a line 110. If the subscriber wants to have xDSL, then the relay 108 is changed so that the old connection is broken and a new connection is made towards to splitter filter 105 instead. Thus a connection is provided from the subscriber's terminal 101 to the line card over the splitter filter 105, like in FIG. 3, and thus access to the xDSL modem 104 will also be obtained.

There are also other alternatives on where and how to connect the cross-connect and the exact placement is of no relevance for the present invention.

Figure 5A:
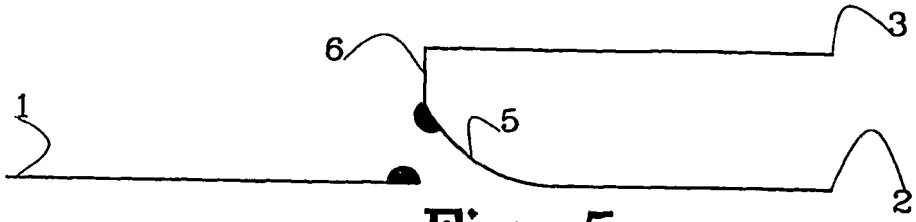

A cross-connect may look in different ways. A preferred embodiment is for the cross-connect to include a switch-matrix with relays. FIGS. 5*a* and *b* shows a new type of fuse-relay, which includes a first pole 1, a second pole 2 and a third pole 3. A fuse 6 is connected between the second pole 2 and the third pole 3. A switch 5 is connected between the first pole 1 and the second pole 2. Said switch 5 can be influenced by the fuse 6 to be either in an open or a closed position.

Figure 5B:
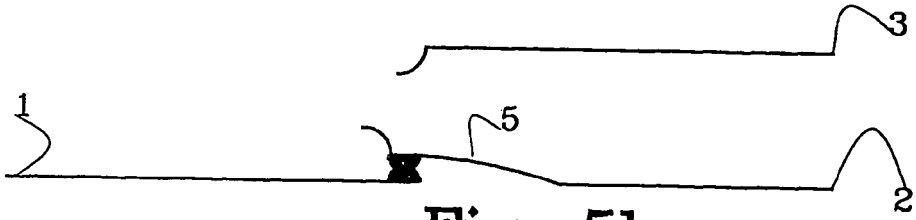

The simplest switch 5 is some sort of resilient device, such as a spring. In FIGS. 5*a* and *b* the resilient device is a blade spring or similar that is positioned in a bent and thus elastically deformed position, thus possessing elastical deformation energy. If in FIG. 5*a* a sufficiently high current is sent between the second pole 2 and the third pole 3 the fuse 6 will blow and thus the blade spring 5 will be released. The result will then be FIG. 5*b*, in which the first pole 1 and the second pole 2 now will be connected.

In many cases, it would be much more advantageous to separate the fuse and the switch totally. Examples of a four-pole fuse relay are disclosed in FIGS. 6*a* and *b*, 7*a* and *b*, 8*a* and *b* and 9*a* and *b*. There is in some way a switch 15, 25, 35, 85 between a first pole 11, 21, 31, 81 and a second pole 12, 22, 32, 82. A fuse 16, 26, 36, 86 is connected between a third pole 13, 23, 33, 86 and a fourth pole 14, 24, 34, 84. This makes it possible to transmit a sufficiently high current between the third pole 13, 23, 33, 83 and the fourth pole 14, 24, 34, 84 in order to blow the fuse 16, 26, 36, 86 without affecting anything connected to the first pole 11, 21, 31, 81 or the second pole 12, 22, 32, 42. Further, some sort of resilient device, spring, is connected to the third pole 13, 23, 33, 43 and is held in an elastically deformed position by the fuse 16, 26, 36, 86, thus binding energy. When the fuse 16, 26, 36, 86 is blown the spring will be released and will cause the connection of the first pole 11, 21, 31, 86 with the second pole 12, 22, 32, 82.

Figure 6A:
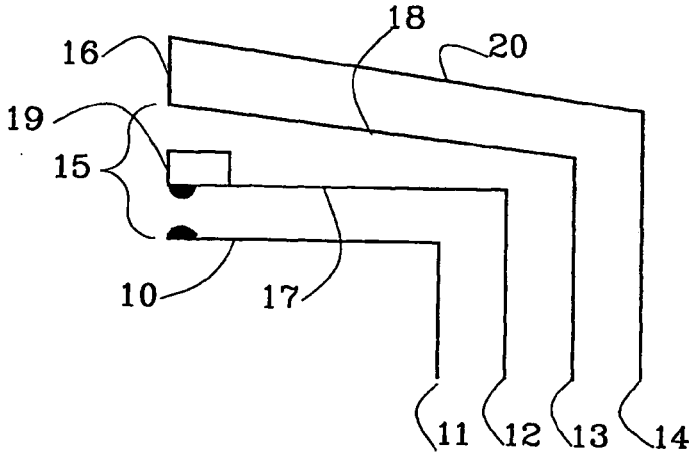
Figure 6B:
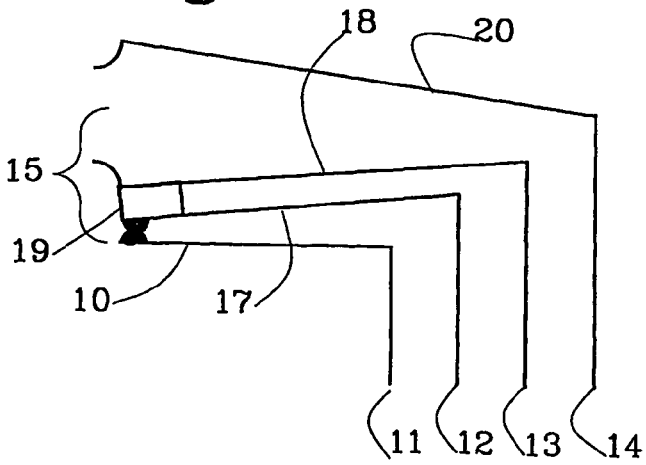

In FIGS. 6*a* and *b* the relay includes a first metal blade 10 connected to the first pole 11, a second metal blade 17, connected to the second pole 12, a third metal blade 18 connected to the third pole 13, a fourth metal blade 20 connected to the fourth pole 14 and an insulator 19 somewhere between the second metal blade 17 and the third metal blade 18, preventing the second metal blade 17 and the third metal blade 18 to come into electrical contact. When the fuse 16 is whole, then the third metal blade 18—acting as a blade spring—is in a bent, i.e. elastically deformed, position as in FIG. 6*a*. But if the fuse 16 is blown, see FIG. 6*b*, then the third metal blade 18 will be released and will instead, via the insulator 19, press the second metal blade into electrical contact with the first metal blade. Thus, the first pole 11 and the second pole 12 will now be in electrical contact.

Figure 7A:
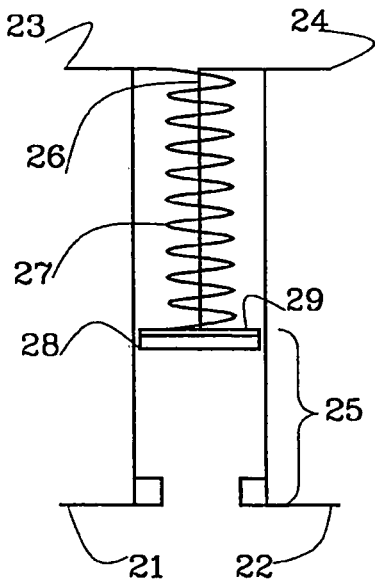
Figure 8A:
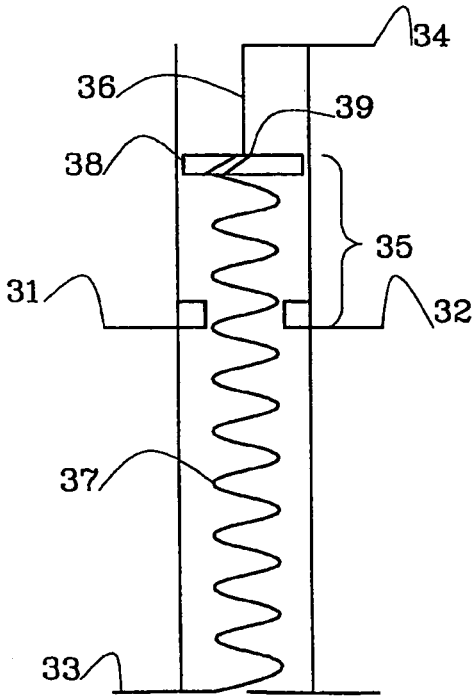

In FIGS. 7*a* and *b* and 8*a* and *b* the relay includes a coil spring 27, 37 with a switch contact 28, 38. The spring is held in an elastically deformed position—either compressed, FIG. 7*a*, or stretched, FIG. 8*a*—with the aid of the fuse 26, 36. There is electrical contact between the fuse 26, 36 and the spring 27, 37, so that a current can flow between the third pole 23, 33 and the fourth pole 24, 34 in order to blow the fuse 26, 36. However, both the fuse 26, 36 and the spring 27, 37 are insulated from the switch contact 28, 38 by means of some kind of insulation 29, 39.

Figure 7B:
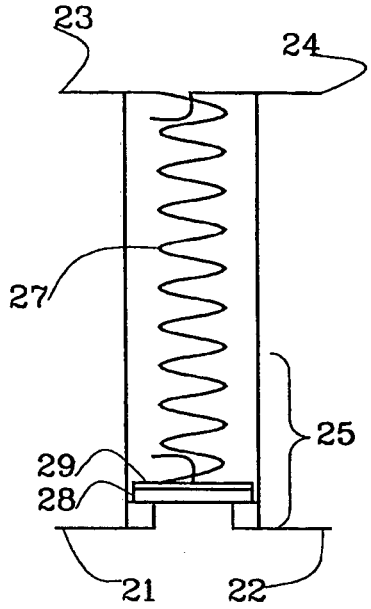
Figure 8B:
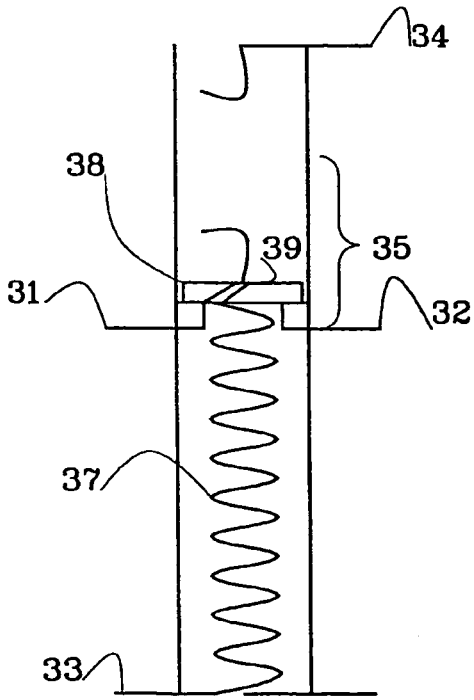

When the fuse is blown, see FIGS. 7*b* and 8*b*, the spring 27, 37 will be released and the switch contact 28, 38 will be pressed against the first pole 21, 31 and the second pole 22, 32 to make electrical contact between the first pole 21, 31 and the second pole 22, 32.

Figure 9A:
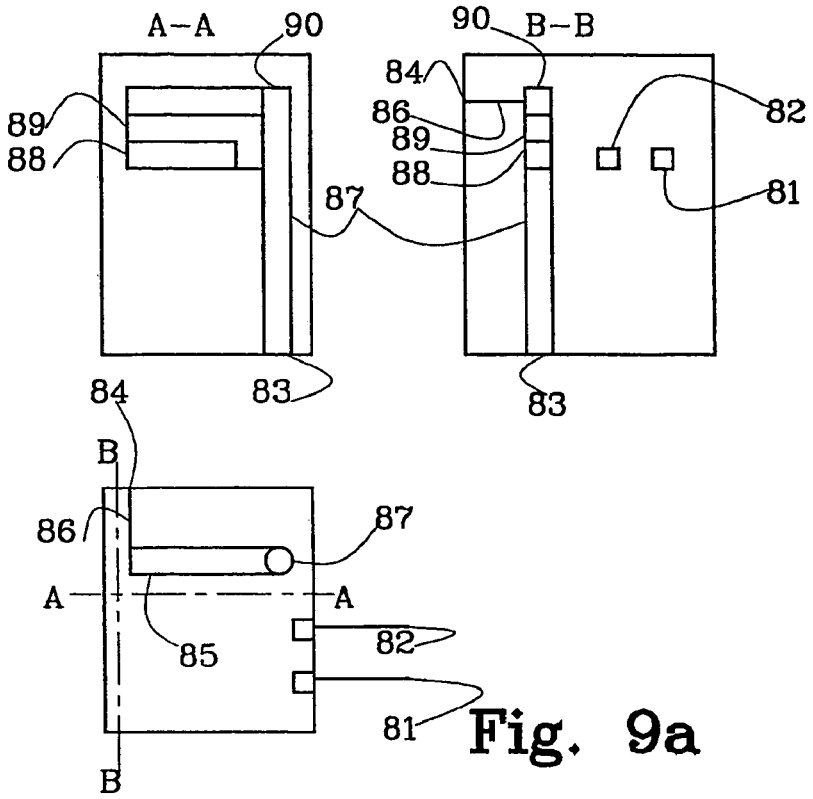
Figure 9B:
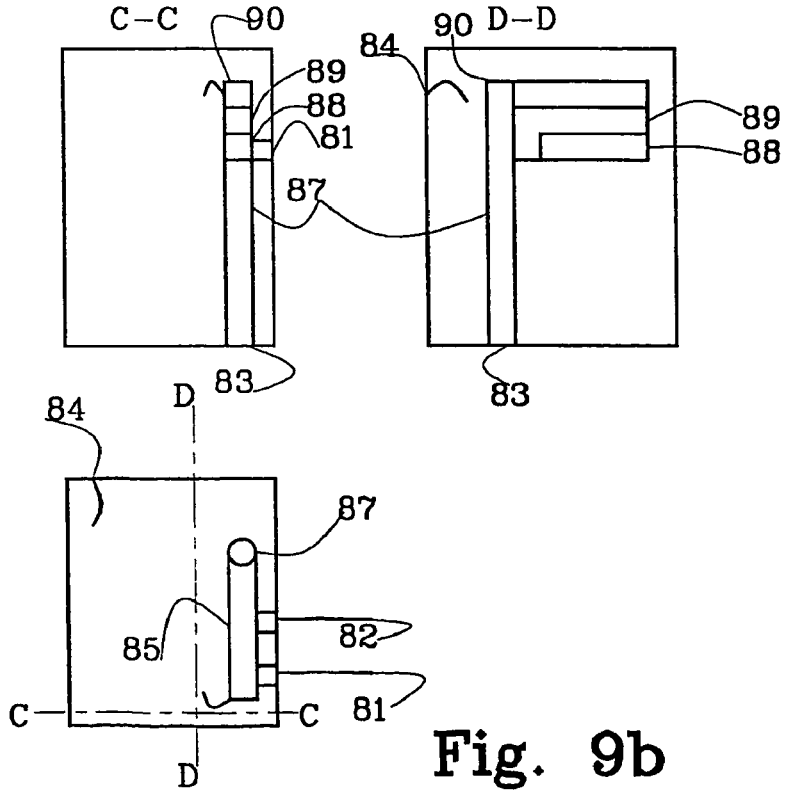

In FIGS. 9*a* and 9*b* the relay includes a torsion spring 87 with a switch contact 88. The spring is held in an elastically deformed position with the aid of the fuse 86—i.e. the upper end 110 of the spring is twisted around the axis of the spring, while the lower end 83 is not. There is electrical contact between the fuse 86 and the spring 87, so that a current can flow between the third pole 83 and the fourth pole 84 in order to blow the fuse 86. However, both the fuse 86 and the spring 87 are insulated from the switch contact 88 by means of some kind of insulation 89.

When the fuse is blown, see FIG. 9*b*, the spring 87 will be released and the switch contact 88 will be pressed against the first pole 81 and the second pole 82 to make electrical contact between the first pole 81 and the second pole 82.

Figure 10A:
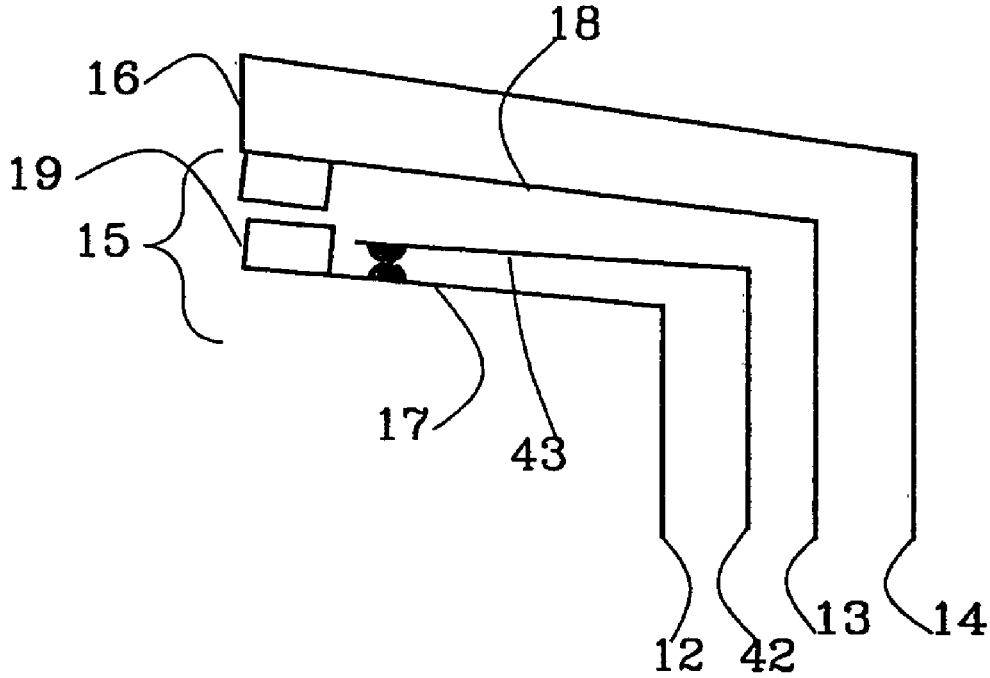

In FIGS. 10*a* and *b*, 11*a* and *b*, 12*a* and *b* and 13*a* and *b* the relays of make contact type in FIGS. 6*a* and *b*, 7*a* and *b*, 8*a* and *b* and 9*a* and *b*, respectively, are modified into relays of break contact type, which means that the first pole and the second pole will work differently compared to the earlier Figures.

In FIGS. 10*a* and *b*, the first pole 42 is connected to a first metal blade 43 placed in such a way that when the fuse 16 is whole there will be a connection between the second metal blade 17 and the first metal blade 43 and thus between the second pole 12 and the first pole 41. Thus, the second metal blade 17 and/or the first metal blade 43 is/are preferably in an elastically deformed position, i.e. somewhat bent, to ensure good contact.

Figure 10B:
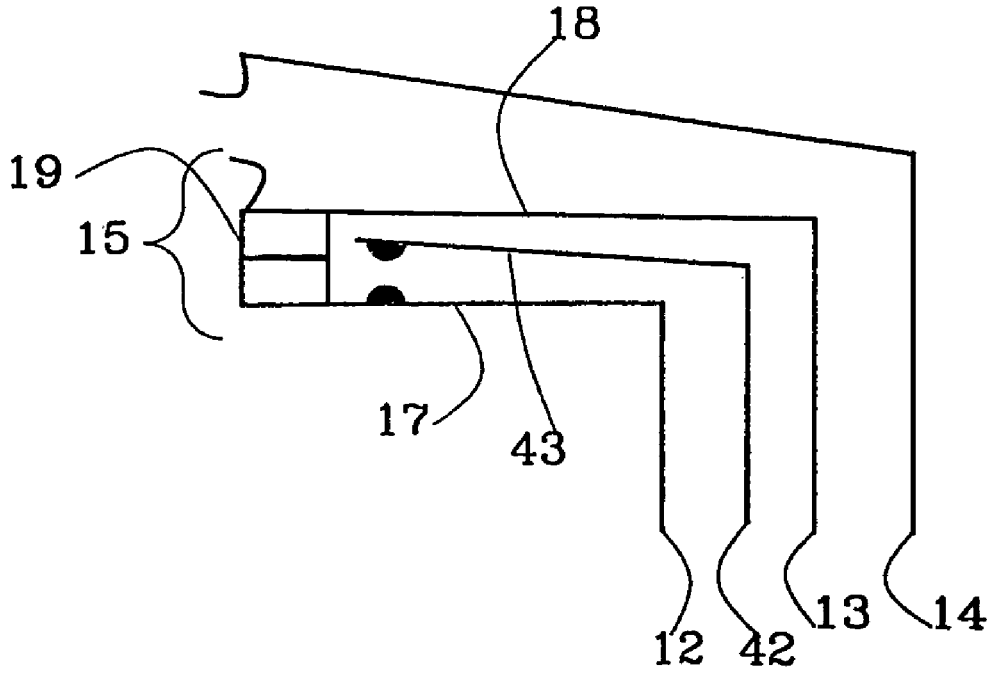

When the fuse 16 is blown, see FIG. 10*b*, then the third metal blade 18 will be released and the second metal blade 17 will be moved as described in connection with FIGS. 6*a* and *b*. This means that the connection between the second pole 12 and the first pole 41 will be broken.

Figure 11A:
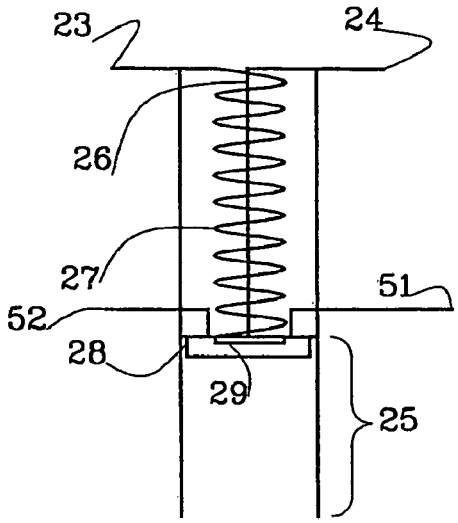
Figure 11B:
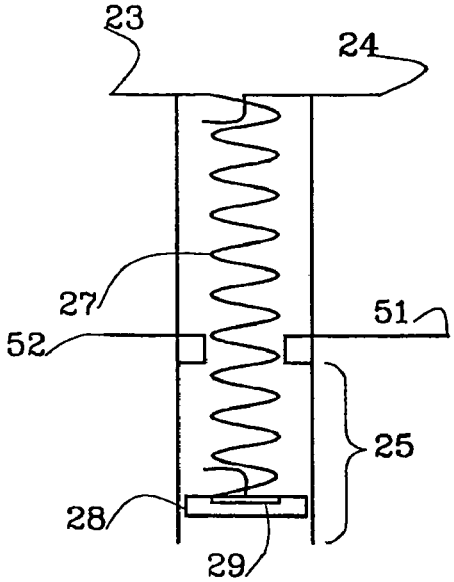
Figure 12A:
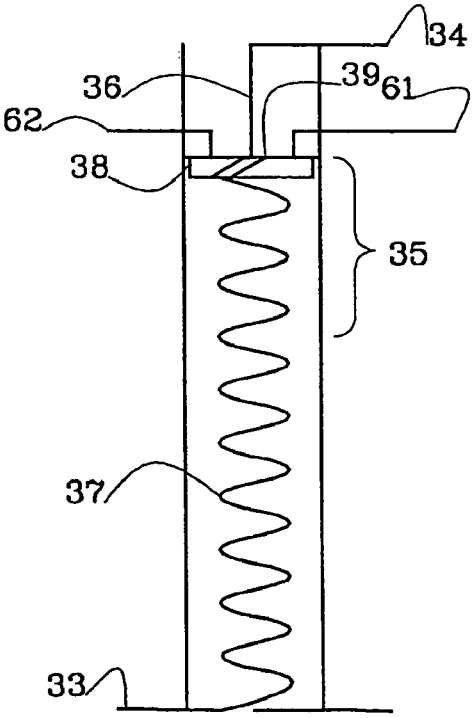
Figure 12B:
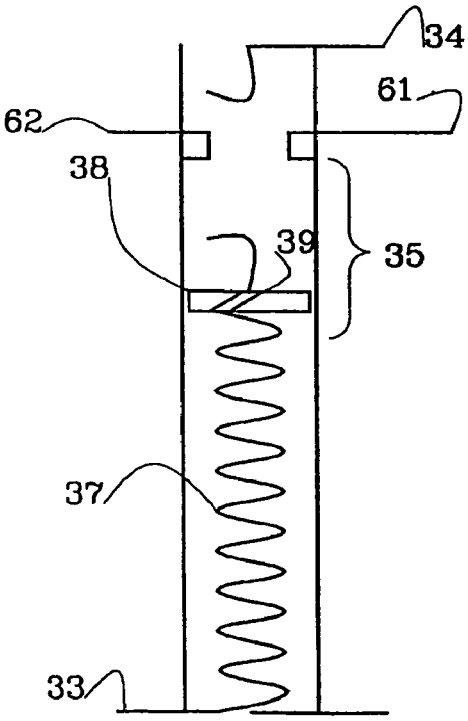
Figure 13A:
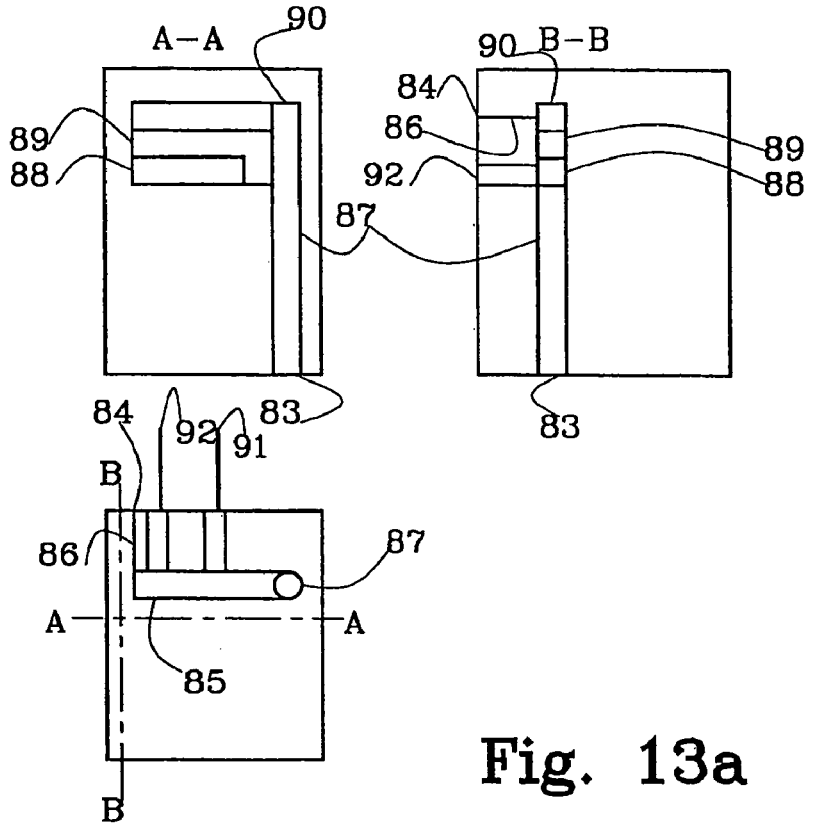
Figure 13B:
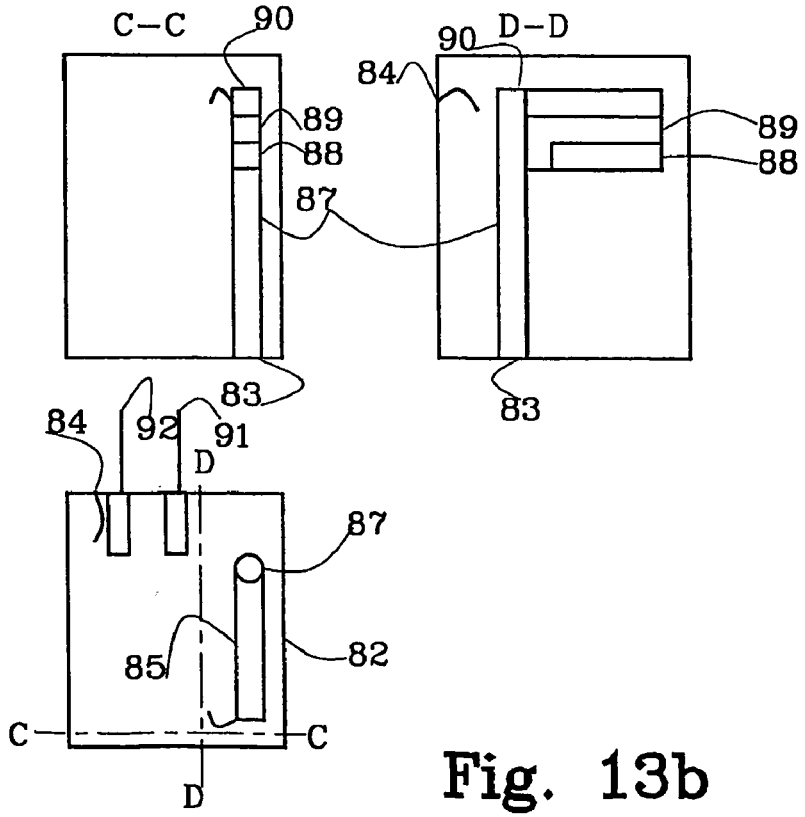

In FIGS. 11*a* and *b*, FIGS. 12*a* and *b* and FIGS. 13*a* and *b* the switch contact 28, 38, 88 makes connection between the second pole 51, 61, 91 and the first pole 52, 62, 92 when the fuse 26, 36, 88 is whole. However, see FIGS. 11*b*, 12*b* and 13*b*, when the fuse 26, 36, 96 is blown, then the spring 27, 37, 87 will be released and moved as described in connection with FIGS. 7*a* and *b*, 8*a* and *b* and 9*a* and *b*, respectively, and thus said connection will be broken. In FIGS. 11*a* and *b*, FIGS. 12*a* and *b* and FIGS. 13*a* and *b* the fuse 26, 36, 86 will alone hold the switch contact to make contact between the first pole 52, 62, 92 and the second pole 51, 61, 91. Preferably, thus, the fuse 26, 36, 86 should be resiliently suspended, so as to press the switch contact into place.

Figure 14A:
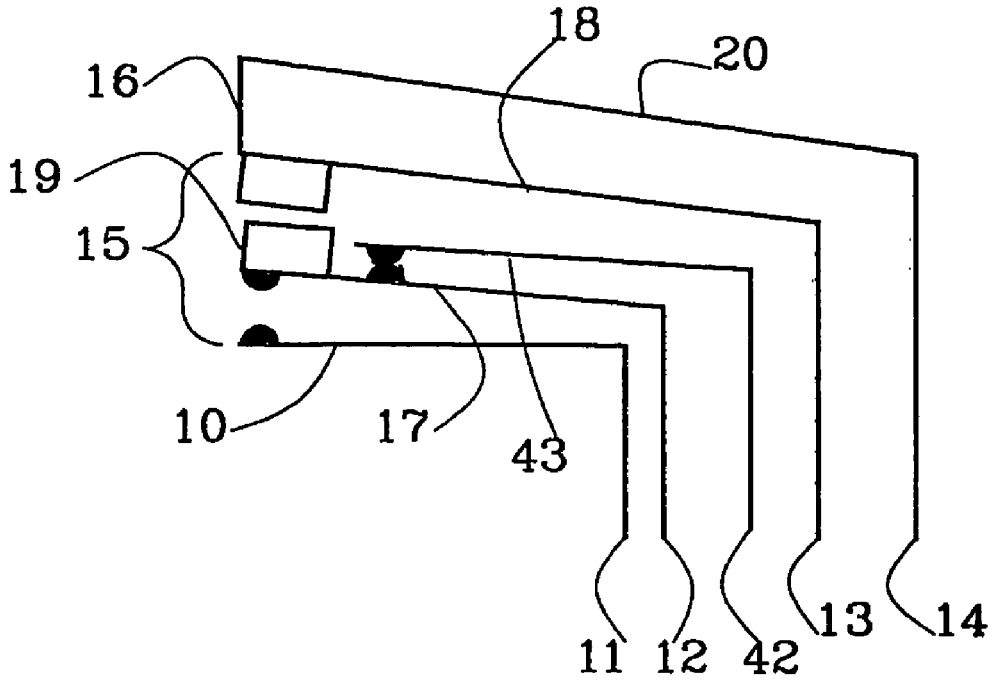

In FIGS. 14*a* and *b*, 15*a* and *b*, 16*a* and *b* and 17*a* and *b* the relays of make contact type in FIGS. 6*a* and *b*, 7*a* and *b*, 8*a* and *b* and 9*a* and *b*, respectively, and the relays of break contact type in FIGS. 10*a* and *b*, 11*a* and *b*, 12*a* and *b* and 13*a* and *b*, respectively are combined into changeover-relays of the type break-before-make. In the FIGS. 14*a* and *b*, 15*a* and *b*, 16*a* and *b* and 17*a* and *b* the first pole from FIGS. 10*a* and *b*, 11*a* and *b*, 12*a* and *b* and 13*a* and *b* will now be called the fifth pole.

Figure 14B:
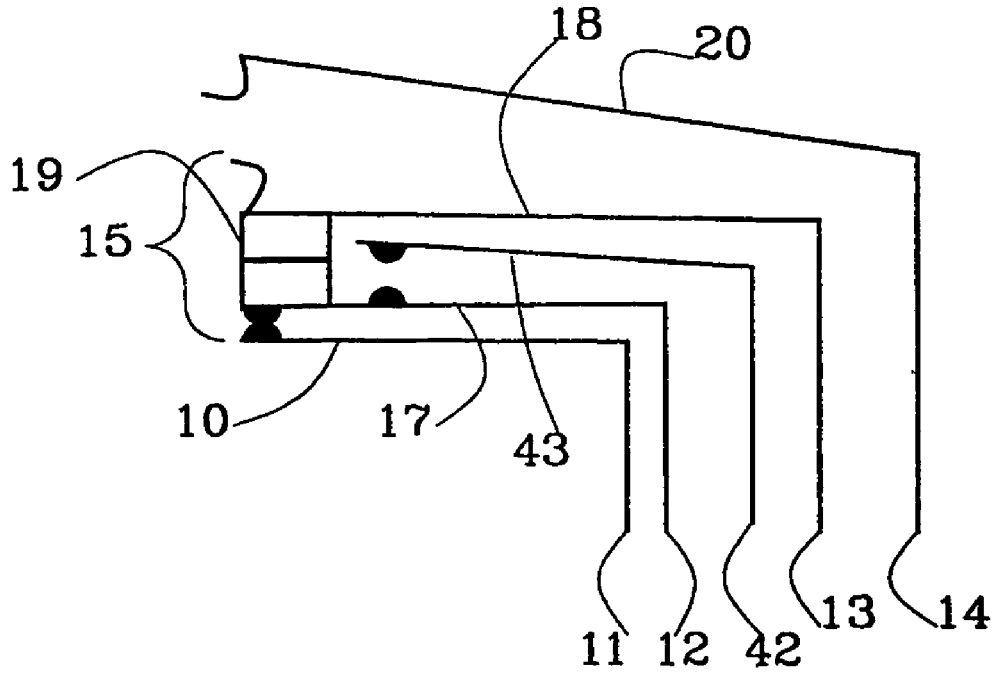

In FIGS. 14*a* and *b*, a fifth pole 41 is connected to a fifth metal blade 42 placed between the second metal blade 17 and the third metal blade 18 in such a way that when the fuse 16 is whole there will be a connection between the second metal blade 17 and the fifth metal blade 42 and thus between the second pole 12 and the fifth pole 41. When the fuse 16 is blown, see FIG. 14*b*, then the third metal blade 18 will be released and the second metal blade 17 will be moved as described in connection with FIGS. 6*a* and *b*. This means that the connection between the second pole 12 and the fifth pole 41 will be broken and instead there will be a connection between the second pole 12 and the first pole 11.

Figure 15A:
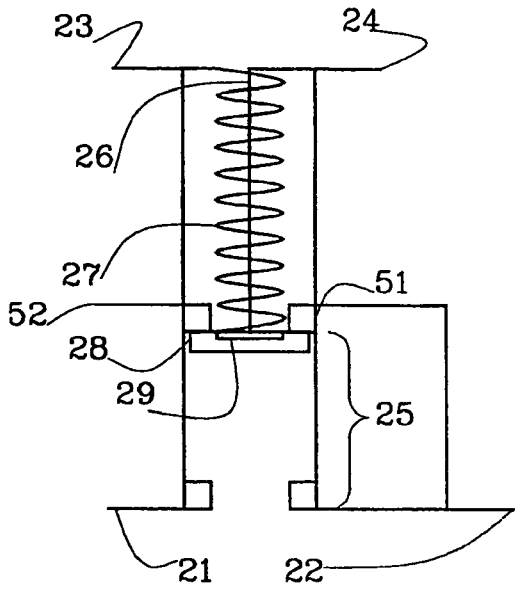
Figure 15B:
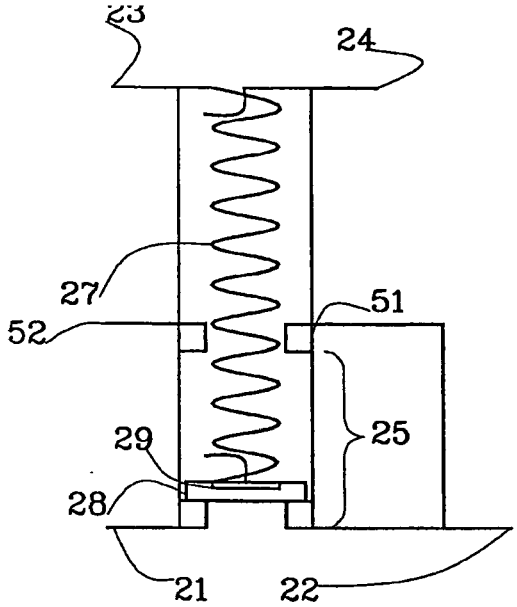
Figure 16A:
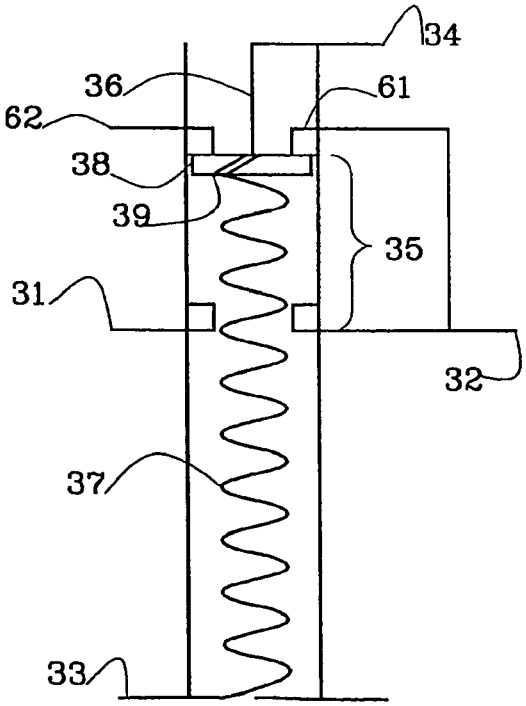
Figure 16B:
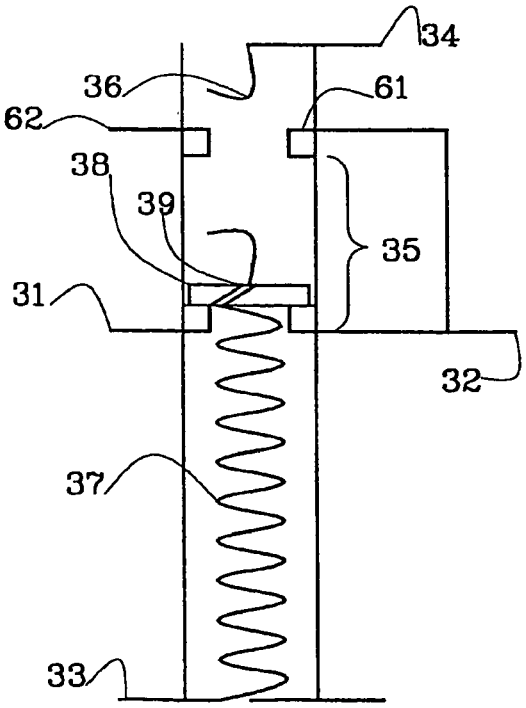
Figure 17A:
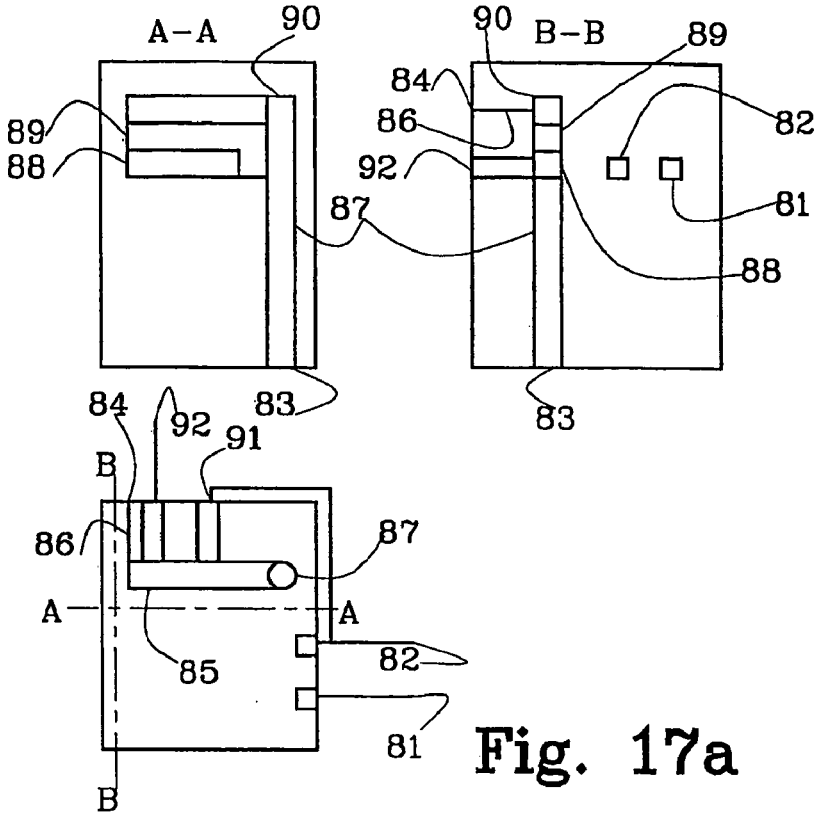
Figure 17B:
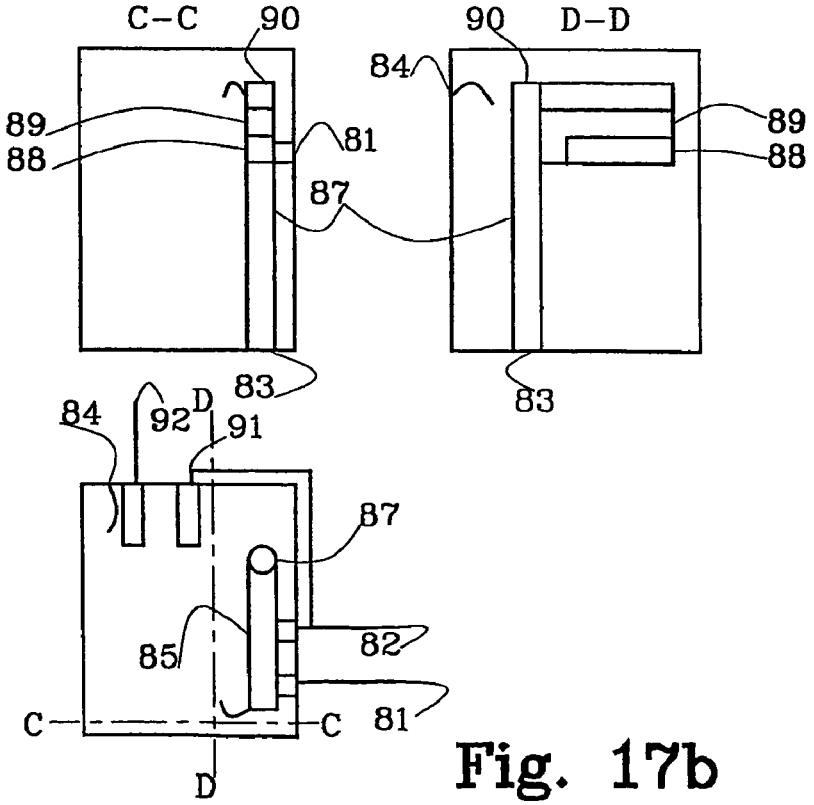

In FIGS. 15*a* and *b*, 16*a* and *b* and FIGS. 17*a* and *b* the second pole 22, 32, 82 has an additional connection point 51, 61, 91 to which the switch contact 28, 38, 88 makes connection when the fuse 26, 36, 86 is whole. Further, the switch contact 28, 38, 88 also makes connection to the fifth pole 52, 62, 82 when the fuse 26, 36, 86 is whole. Thus, when the fuse 26, 36, 86 is whole, the second pole 22, 32, 82 is connected with the fifth pole 52, 62, 82. However, see FIGS. 15*b*, 16*b* and 17*b*, when the fuse 26, 36, 86 is blown, said connection will be lost and instead the first pole 21, 31, 81 and the second pole 22, 32, 82 will be connected, as described in connection to FIGS. 7*a* and *b*, 8*a* and *b* and 9*a* and *b*, respectively.

These are some examples on how a fuse-relay may look. The skilled man in the art will vary the fuse-relay in numerous ways without departing from the main idea.

The fuse-relay described above is a one-shot switch and once the fuse has been blown the connection cannot be rebroken/remade except for replacing the fuse with a new fuse or by replacing the fuse-relay with a fuse-relay with a whole fuse. A fuse-relay may be put in a small package possible to put in a socket for easy replacement. The fuse-relay may also be provided with an indicator indicating if the relay is "on" or "off". Further, the fuse-relay may be provided with a test-button or similar in order to test connections without blowing the fuse.

Figure 18A:
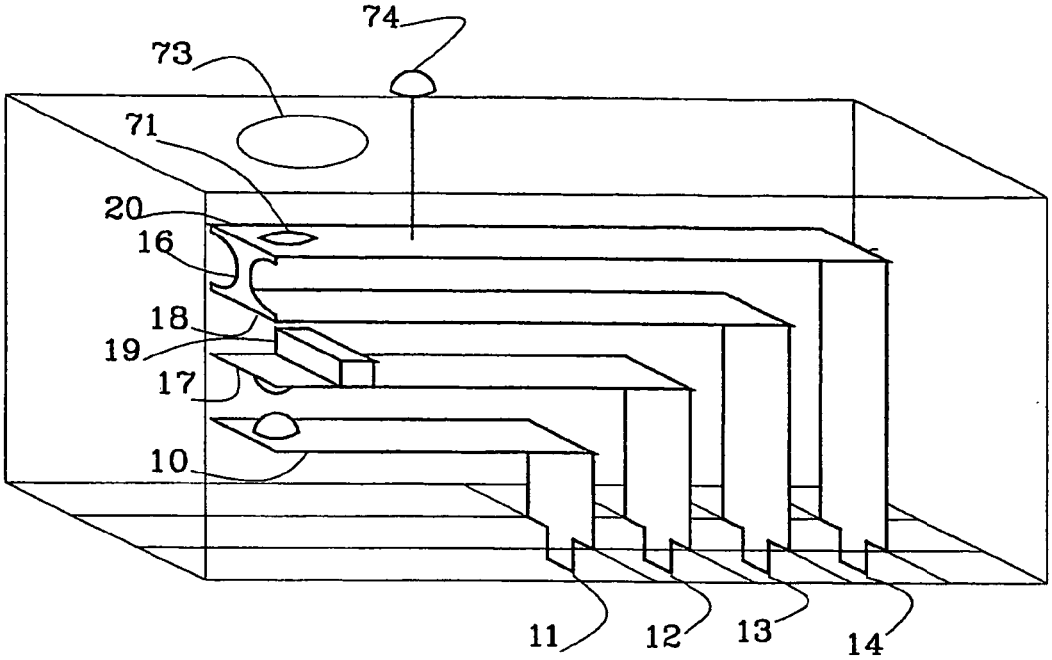
Figure 18B:
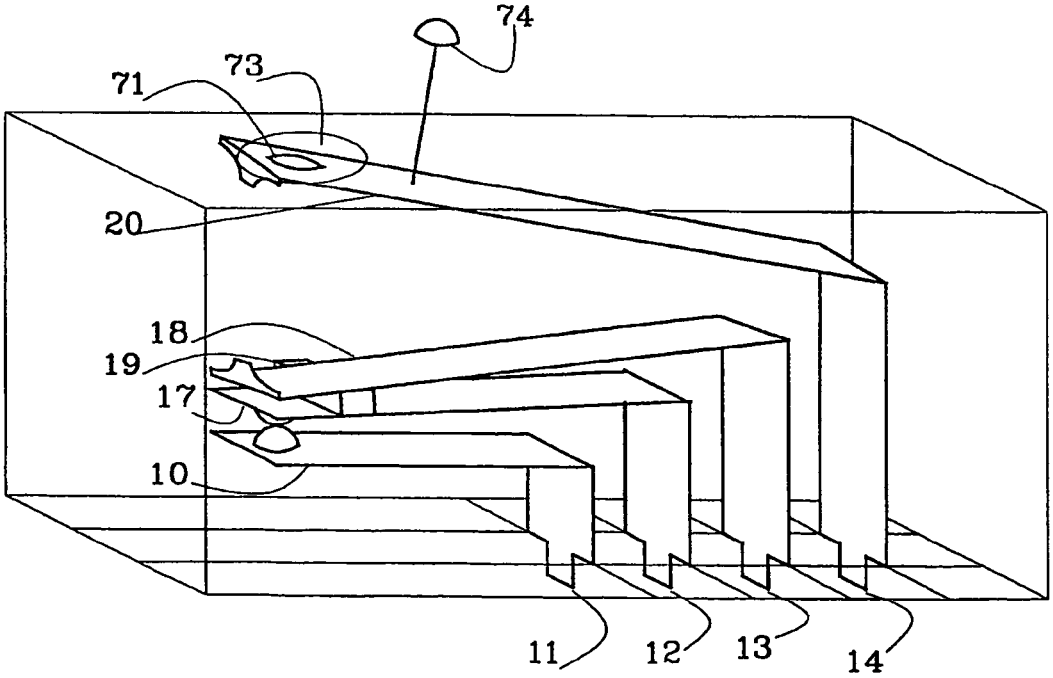

In FIGS. 18*a* and 18*b* is shown an example on how to implement an indicator. FIG. 18*a* corresponds to FIG. 6*a* and FIG. 18*b* corresponds to FIG. 6*b*, however drawn three-dimensional. Further, an indicator 71 is added on top of the fourth metal blade 20. The fourth metal blade 20 is also held in a bent, i.e. elastically deformed, position by the fuse 16 and thus works as a blade spring. When the fuse 16 is blown, see FIG. 8*b*, then the fourth metal blade 20 will be released and the indicator 71 will be seen in a window 73 or similar.

That was a mechanical solution on how to indicate. Of course it is also possible to find electrical solutions, such as to test the connection by transmitting a weak current between the third pole and the fourth pole and to see if there is a connection or not, i.e. to see if the fuse is whole or not, e.g. by making a circuit light a light emitting diode. The current should of course then not be so strong as to blow the fuse.

Figure 18C:
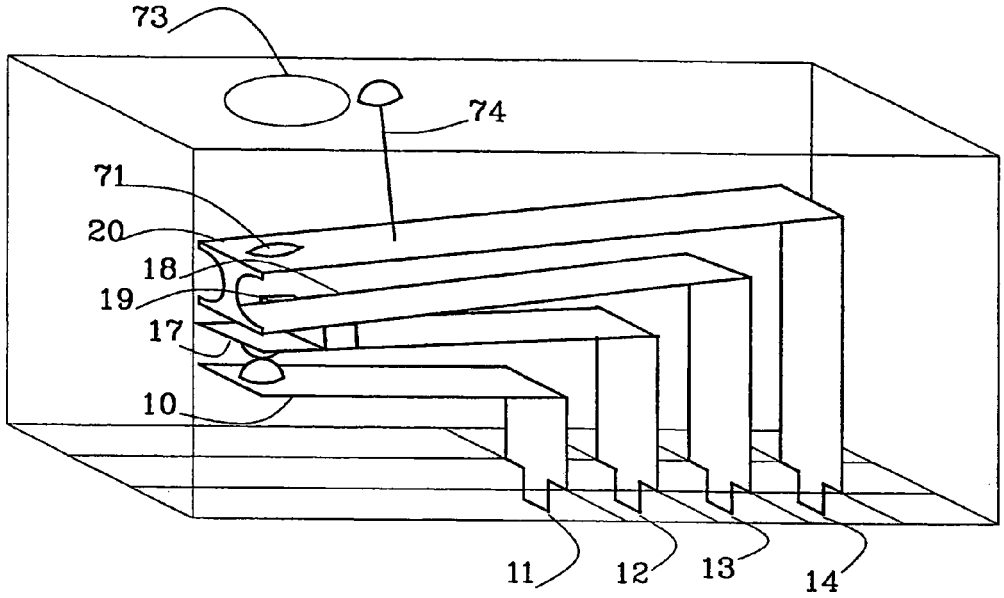

In FIG. 18*a* is also indicated a test button 74. When the test button 74 is pressed, see FIG. 18*c*, an electrical contact will temporarily be created between the first pole 11 and the second pole 12, without having to blow the fuse 16. Thus, the connection may be tested.

Figure 19A:
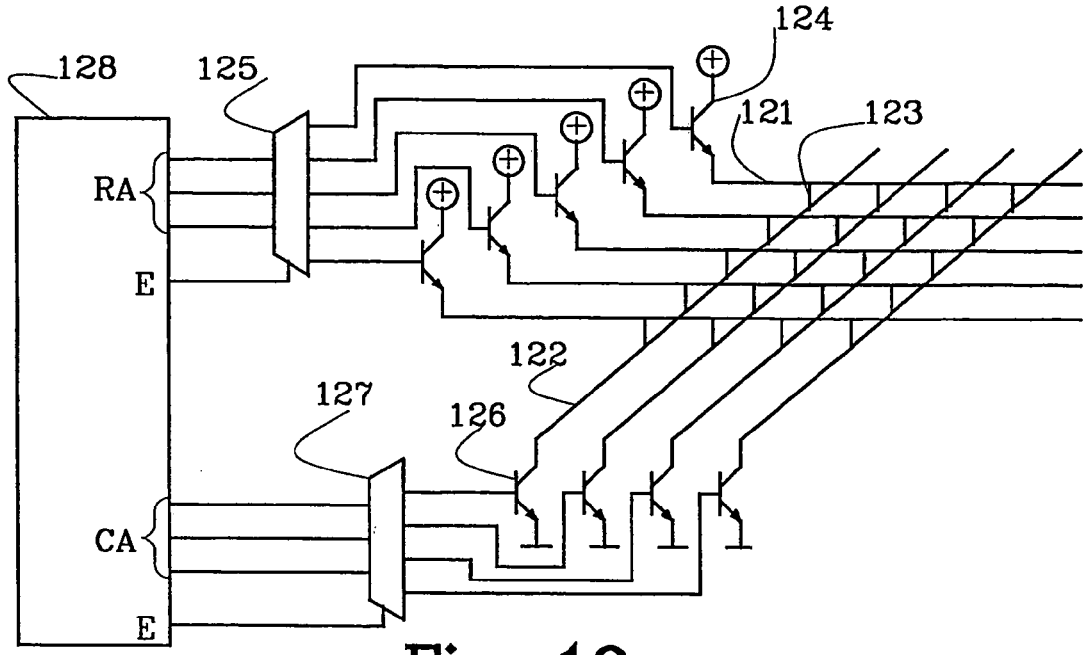
FIG. 19*c* shows a second embodiment of the switch part of a cross-connect according to the invention
FIG. 19*d* shows a third embodiment of the switch part of a cross-connect according to the invention

A cross-connect can be made using the fuse-relays described above, e.g. by making a switch-matrix as shown in FIG. 19*a*, showing simplified the fuse part of the switch matrix and 19*b*, showing simplified the relay part of the switch matrix.

The fuse part of the switch matrix is built up from addressing rows 121 and addressing columns 122 and with a fuse 123 connected in each cross-point of the addressing rows 121 and addressing columns 122. In FIG. 19*a* the fuses 123 are drawn schematically as if directly connected between the addressing rows 121 and addressing columns 122. In practise—compare FIGS. 6 to 17—the third pole of the fuse-relay will be connected to the addressing row 121 and the fourth pole will be connected to the addressing column 122 or vice versa.

Addressing of a certain fuse-relay—in order to blow its fuse to make a connection—can be made by selecting one addressing row 121 and one addressing column 122 and transmitting a sufficiently high current through said addressing row 121 and addressing column 122. An example on how this can be done is shown in FIG. 19*a*. For each addressing row 121, a transistor 124 is connected with its emitter to said addressing row 121, with its collector connected to a power source and with its base connected to a row demultiplexor 127. For each addressing column 122, a transistor 126 is connected with its collector to said addressing column 122, with its emitter connected to ground and with its base connected to a column demultiplexor 127. Naturally, it will work equally well if the connections for the addressing rows and addressing columns are interchanged. The row demultiplexor 125 and the column demultiplexor 127 have inputs to receive a row address RA and a column address CA, respectively, from a control unit 128 or similar. The demultiplexors further have inputs for enable signals E.

Figure 19B:
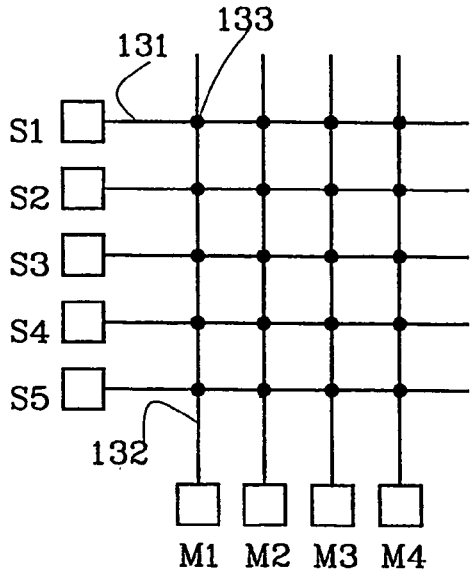
Figure 19C:
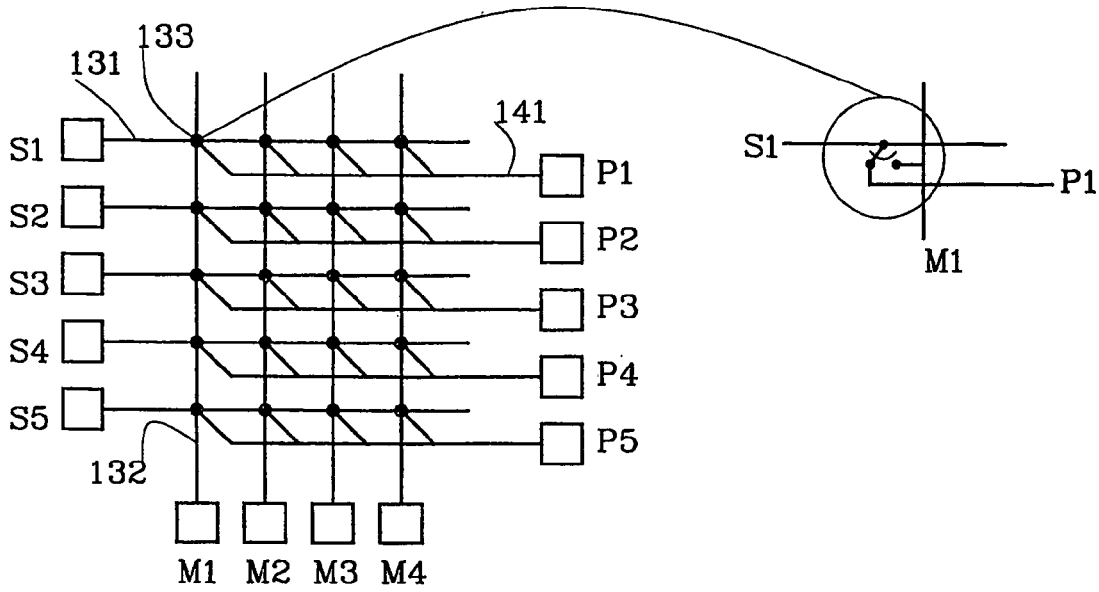

The switch part of the matrix in FIG. 19*b* includes in a corresponding way switching rows 131 and switching columns 132 with switches 133 connected between them, i.e.—compare FIGS. 6 to 17—the first pole of a fuse-relay is connected to a switching row 131 and the second pole of a fuse-relay is connected to a switching column 132 or vice versa.

Figure 19D:
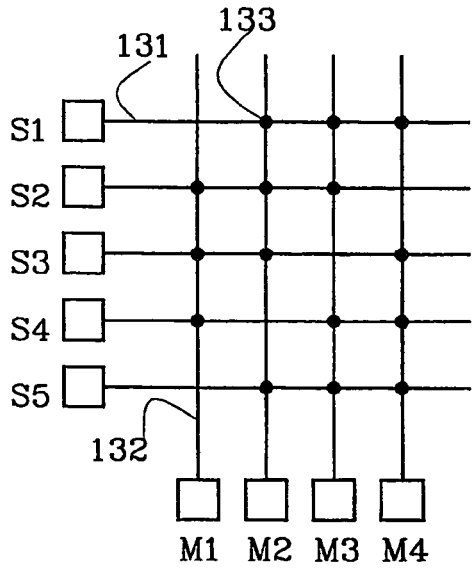

When the change-over fuse-relays in FIGS. 14 to 17 are used, there will be additional switching rows 141, see FIG. 19*d*.

In order to use the cross-connect for connecting xDSL modems, compare FIGS. 2 and 19, a cross-connect 105 with fuse-relays of make contact type, compare also FIGS. 5 to 9, can now be connected with the switching rows 131 connected towards the subscribers' terminals and with the switching columns 132 connected towards the xDSL modems 104. In telecommunication each subscriber line will include two wires, which means that the fuse-relays should be dual fuse-relays, i.e. with one switch per wire working simultaneously.

In FIG. 3, the switching rows 131 will be connected towards the subscribers' terminals 101 and the line cards 103, respectively, and the switching columns 132 will be connected towards the splitter filters 105. Also here fuse-relays of make contact type will be used, compare FIGS. 5 to 9, but additionally also fuse-relays of break contact type for the separate relays 108.

In FIG. 4, cross-connects 116, 117 with change-over fuse relays, will be used, compare FIGS. 14 to 17 and FIG. 19*d* and the additional switching columns 131 of the first cross-connects 116 will be connected to the additional switching columns in the second cross-connect 117.

Connecting an xDSL modem can be made remotely, by addressing an addressing row 121 and column 122 and enabling the addressing with an enable signal E. Then a current will flow in said addressing row 121 and column 122, whereupon the corresponding fuse 123 will blow. Consequently the corresponding switching row 131 and column 132 will be connected, thereby connecting the subscriber's terminal with the selected xDSL modem. If the fuse-relay is provided with an indicator, then said indicator will now indicate that a connection with the xDSL modem has been made.

Preferably, there will be in the switch control unit some type of check in the addressing of the modem, so as to prevent selection of a modem which is already selected.

Figure 20:
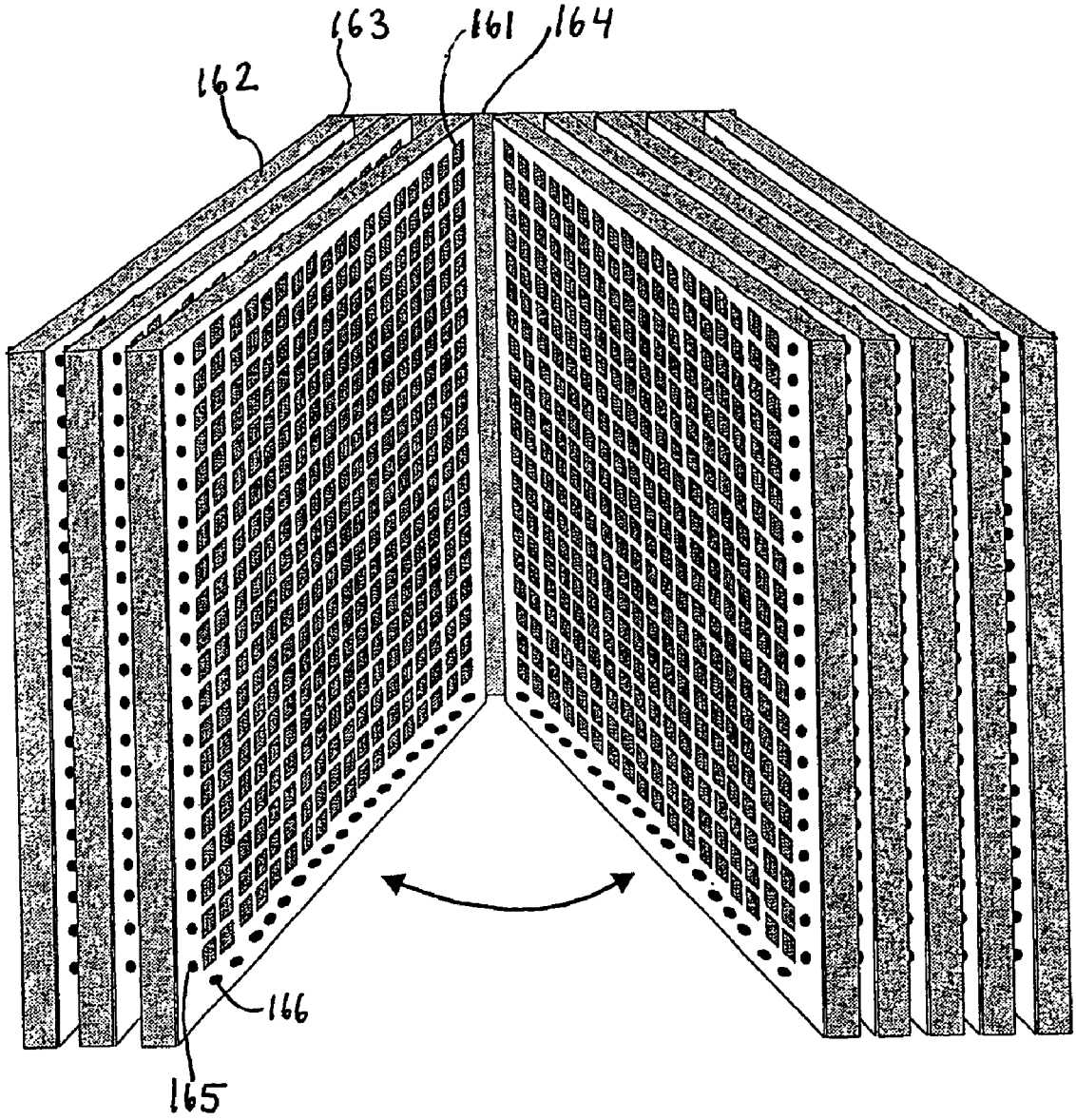
FIG. 20 shows a practical implementation of a cross-connect according to the invention

In FIG. 20 is shown a practical example of a cross-connect with many fuse-relays 161. The cross-connect is arranged like a book, and is divided in several "pages" 162, with the rear sides 163 of the "pages" mounted on a back 164 with "hinges" or other similar means, so that the "pages" 162 are movable like the pages in a book. This facilitates changing of a fuse-relay 161, when necessary.

To facilitate the finding of the fuse-relay that is to be changed, light emitting diodes 165, 166 can be used. If it is previously selected somewhere which fuse-relay is to be changed, then the row with said fuse-relay may be indicated with a row light emitting diode 165 and the column with said fuse-relay may be indicated with a column light emitting diode 166. This method of indicating may of course also be employed if the cross-connect is not in the form of a book.

A full "all to all" switch matrix will require $N_C \cdot N_M$ number of relays, where $N_C$ is the number of subscriber lines and $N_M$ is the number of modems. It is, however, possible to reduce the number of relays if a small probability of "no unused modem available" is allowed. If, in a very large switch matrix, e.g. 10% of the subscribers want to be connected to xDSL and if the modems corresponds to 20% of all subscribers, then it is enough if each subscriber can be connected to about 5 to 10 modems. This corresponds to 5–10 relays per subscriber. In this case it is possible to automatically connect a new subscriber in 99% of the cases. In the rest of the cases manual connection is necessary.

If a clever algorithm is used when selecting modem, then the statistics can be improved even further. When selecting a modem, the modem should be selected where the rest of the subscribers able to connect to said modem, either already are connected to another modem, or have the highest possibilities to connect to other modems.

Figure 21A:
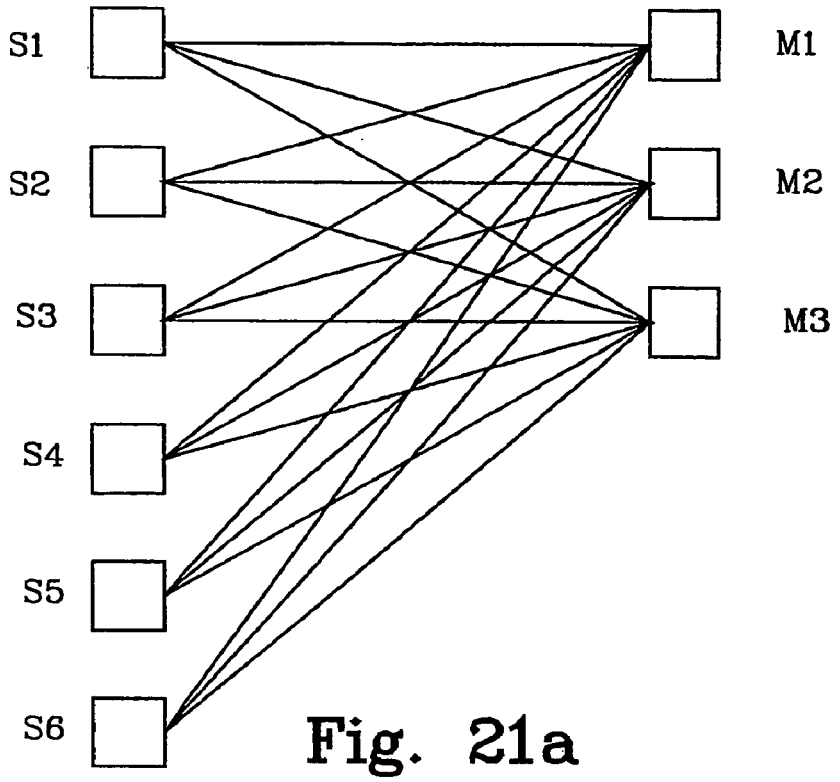
FIG. 21*a* shows a method for reducing the number of relays in a cross-connect according to the invention
Figure 21B:
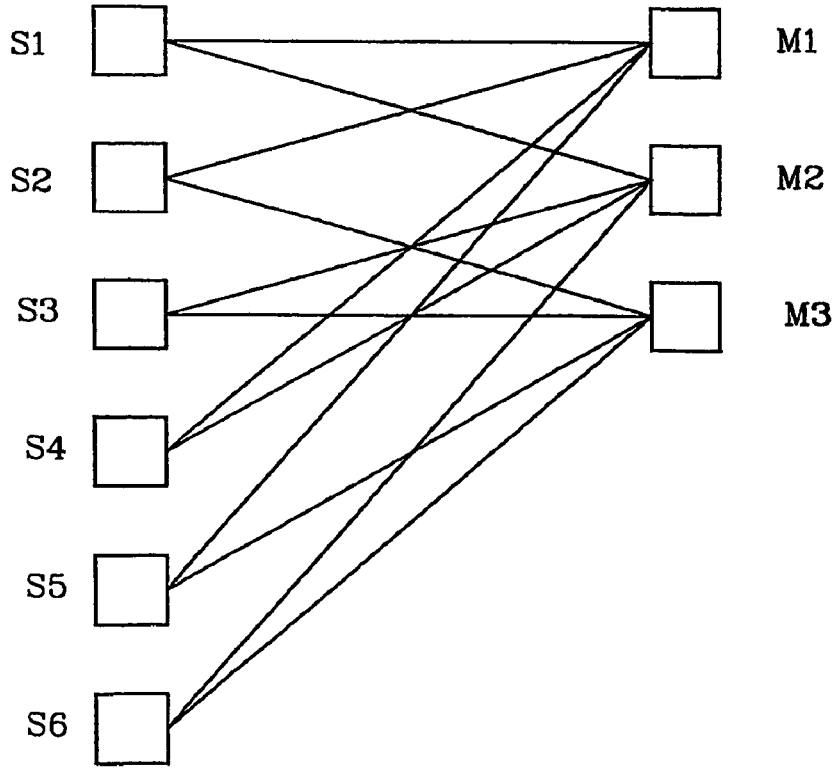

In FIGS. 21*a* and *b* is shown an example with five subscribers S1, S2, S3, S4, S5 and three modems M1, M2, M3. For a full connection, see FIG. 21*a*, each subscriber should have had connection possibilities with all three modems making it 5·3=15 connection possibilities. However, in FIG. 21*b*, as an example, it is chosen that each subscriber has only two connection possibilities in a way that the first subscriber S1 can select the first modem M1 or the second modem M2, the second subscriber S2 can select the first modem M1 or the third modem M3, the third subscriber S3 can select the second modem M2 or the third modem M3, the fourth subscriber S4 can select the first modem M1 or the third modem M3, the fifth subscriber MS5 can select the second modem M2 or the third modem M3.

Let us say that the first subscriber S1 wants to be connected to a modem. There is the choice between the first modem M1, to which three other subscribers S2, S4, S5 have the possibility to be connected, and the second modem M2, to which three other subscribers S3, S4, S6 have the possibility to be connected, counting only the subscribers who are not already connected to a modem. Looking at the subscribers S2, S4, S5 with the possibility to be connected to the first modem M1; each of them has a possibility to be connected to two modems. The same situation occurs at the second modem M2. Further, there are equally many connection possibilities to the first modem M1 as to the second modem M2. Thus, any of the modems M1, M2 can be selected. Let us select to connect the first subscriber S1 to the first modem M1.

Now the first modem M1 is occupied, meaning that some subscribers S2, S4, S5 only have one choice of modem, e.g. if the second subscriber S2 wants to be connected to a modem, it is only possible to select the third modem M3. However, let us say it is the third subscriber S3 that wants to be connected to a modem. The third subscriber has the choice between the second modem M2, to which two other subscribers S4, S6 have the possibility to be connected (not counting the first subscriber S1, who is already connected to a modem), and the third modem M3, to which three other subscribers S2, S5, S6 have the possibility to be connected. Looking at the subscribers S4, S6 with the possibility to be connected to the second modem M2; the fourth subscriber S4 can only select the second modem M2, while the sixth subscriber S6 also can select the third modem M3. Looking at the subscribers S2, S5, S6 with the possibility to be connected to the third modem M3; the second subscriber S2 and the fifth subscriber S5 can only select the second modem M2, while the sixth subscriber S6 also can select the second modem M3.

This means that if the third subscriber S3 is connected to the second modem M2, then if also the fourth subscriber S4 wants to be connected to a modem this cannot be done, but must be solved manually. On the other hand if the third subscriber S3 is connected to the third modem M3, then if also either the second subscriber S2 or the fifth subscriber S5 wants to be connected to a modem this cannot be done, but must be solved manually. Since it is a higher probability that there will be a problem later on if the third modem M3 is selected for the third subscriber S3, it is thus better so select the second modem M2 for the third subscriber S3.

In this way the number of relays can be reduced and thus money saved. Naturally this algorithm can be used in all contexts where many has to select from a few items.

In FIG. 19*d* it is shown how this can be implemented in the cross-connect.

Figure 22:
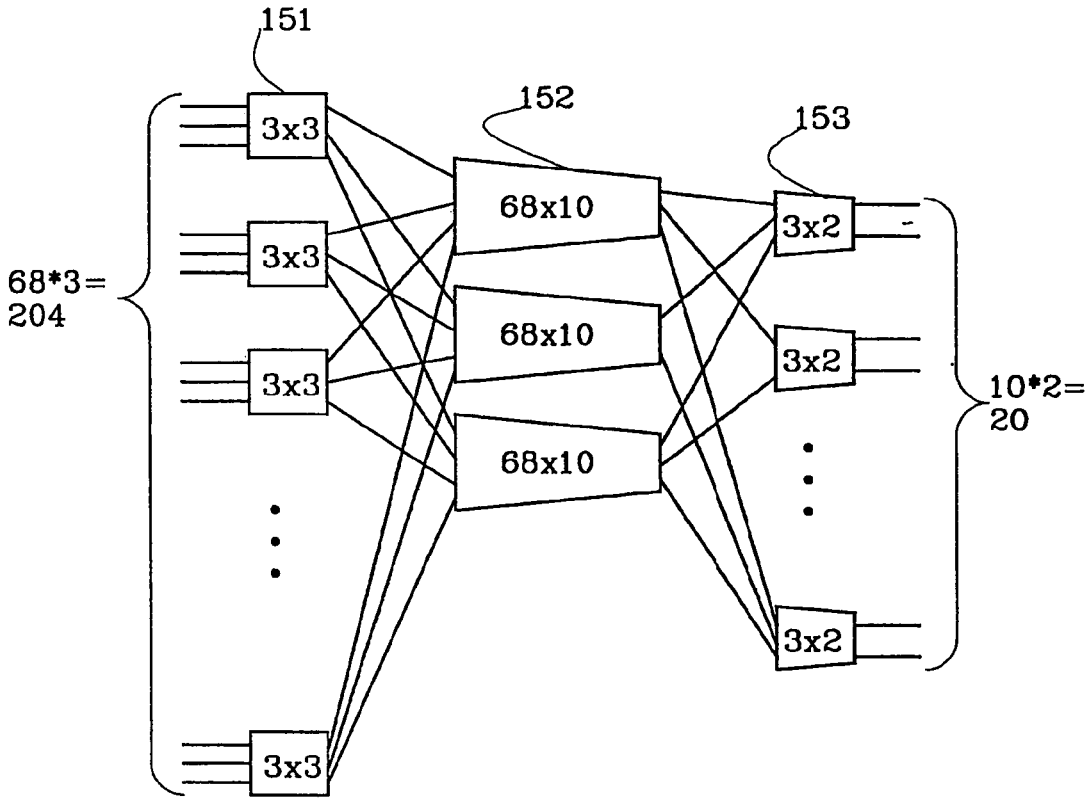
FIG. 22 shows a third embodiment of a cross-connect according to the invention

The cross-connect can also be accomplished by using a multi-step cross-connect, of which an example is shown in FIG. 22. First there is a series of sixty-eight small first switch-matrixes 151, each with three inputs and three outputs to a total of 204 inputs and outputs. The three outputs of the first switch-matrixes 151 are each connected to one of three second switch-matrixes 152, which thus have sixty-eight inputs each. The second switch-matrixes 152 then concentrate the connections by having only ten outputs each. The ten outputs of each second switch-matrix are then each connected to one of ten third switch-matrixes 153, which thus have three inputs each. The third switch-matrixes 153 then concentrate the connections by having only two outputs each. Thus, totally the multi-step cross-connect in FIG. 21 has 204 inputs and 20 outputs. This may naturally be varied in numerous ways without departing from the idea.

It can be shown that further relays can be saved with this configuration. However, to make the most efficient multi-step cross-connect, normal relays should also be included, especially in second switch-matrixes 152, to enable certain reconfigurations of the connections to be made.

In the description above, the cross-connect has consequently been used to select xDSL modems for telecom subscribers. The skilled man in the art will however easily see that the cross-connect can be used also in other contexts where a choice is to be in principle non-reversible. This applies in particular when a few outputs can be chosen by many inputs.

The invention claimed is:

1. A method for connecting one of several first items to one of several second items, wherein the first items and the second items are connected to a cross-connect including switching columns, switching rows, addressing columns, addressing rows and fuse-relays: said method comprising the steps of:

selecting a second item to which a selected first item is to be connected;

addressing an addressing column and an addressing row in the cross-connect; and transmitting a high current through said addressing row and addressing column sufficient to blow a fuse in one of the fuse-relays whereby a connection is caused to be made or broken between a switching row and a switching column, thereby connecting the selected first item with the selected second item;

wherein the first items are terminals and the second items are xDSL modems.

2. A method according to claim 1, wherein the cross-connect further includes additional switching rows, and a connection is caused to be made or broken between a switching row and an additional switching row when the fuse is blown.

3. A method according to claim 1, further comprising the step of selecting the second item where the rest of the first items able to connect to said second item either already are connected to another second item or have the highest possibility to be connected to another second item.

* * * * *